US012624853B2

(12) United States Patent
Dunberger et al.

(10) Patent No.: US 12,624,853 B2
(45) Date of Patent: May 12, 2026

(54) AIR PURIFIER

(71) Applicant: Blueair AB, Englewood Cliffs, NJ (US)

(72) Inventors: Lars Henrik Dunberger, Stockholm (SE); Alagirisamy Nethaji, Mumbai (IN); Johan Daniel Wennerström, Sollentuna (SE)

(73) Assignee: Blueair AB, Englewood Cliffs, NJ (US)

( * ) Notice: Subject to any disclaimer, the term of this patent is extended or adjusted under 35 U.S.C. 154(b) by 941 days.

(21) Appl. No.: 17/799,243

(22) PCT Filed: Feb. 11, 2021

(86) PCT No.: PCT/EP2021/053334

§ 371 (c)(1),
(2) Date: Aug. 11, 2022

(87) PCT Pub. No.: WO2021/160737

PCT Pub. Date: Aug. 19, 2021

(65) Prior Publication Data

US 2023/0081490 A1 Mar. 16, 2023

(30) Foreign Application Priority Data

Feb. 14, 2020 (IN) ..... 202021006449
Feb. 14, 2020 (IN) ..... 202021006450
(Continued)

(51) Int. Cl.
*F24F 8/30* (2021.01)
*F24F 8/108* (2021.01)
(Continued)

(52) U.S. Cl.
CPC ..... *F24F 8/30* (2021.01); *F24F 8/108* (2021.01); *F24F 8/192* (2021.01); *F24F 8/80* (2021.01);
(Continued)

(58) Field of Classification Search
CPC ..... F24F 8/30; F24F 11/77; F24F 8/90; F24F 8/80; F24F 8/192; F24F 8/108;
(Continued)

(56) References Cited

U.S. PATENT DOCUMENTS

2005/0055990 A1 3/2005 Choi et al.
2010/0305761 A1* 12/2010 Remsburg ..... F24F 11/52 700/277
(Continued)

FOREIGN PATENT DOCUMENTS

CN 104913379 A 9/2015
CN 105587139 B 6/2018
(Continued)

OTHER PUBLICATIONS

International Preliminary Report issued in International Patent Application No. PCT/EP2021/053334 dated May 10, 2022.
(Continued)

*Primary Examiner* — Xiuyu Tai
(74) *Attorney, Agent, or Firm* — Carter, DeLuca & Farrell, LLP; George Likourezos; Bret P. Shapiro

(57) ABSTRACT

A portable air purifier comprising a removable filter, an air flow generator, a temperature sensor, a humidity sensor, a processor for processing input from the temperature sensor and the humidity sensor, and means for activating said air flow generator from a stand-by configuration based on input from both said temperature and humidity sensors and a method for activating an air flow generator in a portable air purifier in stand-by mode, by obtaining information as to ambient temperature from a temperature sensor, obtaining information as to ambient humidity from a humidity sensor, determining likelihood of microbial growth on a removable
(Continued)

Figure 1:
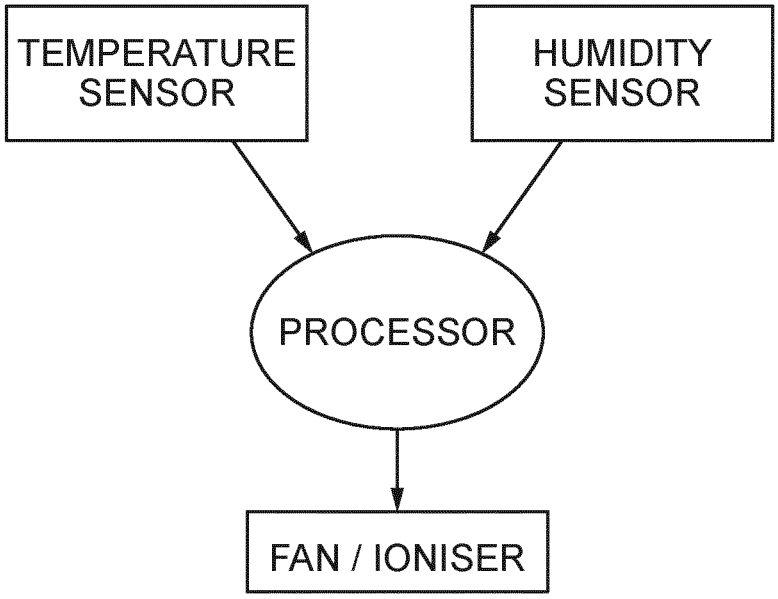

filter in the purifier and, where conditions are such that microbial growth is of a defined quantum, activating the air flow generator.

7 Claims, 1 Drawing Sheet

(30) Foreign Application Priority Data

| | | |
|---|---|---|
| Feb. 14, 2020 | (IN) | 202021006451 |
| Feb. 14, 2020 | (IN) | 202021006452 |
| Feb. 14, 2020 | (IN) | 202021006453 |
| Mar. 30, 2020 | (EP) | 20166863 |
| May 26, 2020 | (EP) | 20176470 |

(51) Int. Cl.

| | |
|---|---|
| ***F24F 8/192*** | (2021.01) |
| ***F24F 8/80*** | (2021.01) |
| ***F24F 8/90*** | (2021.01) |
| ***F24F 11/77*** | (2018.01) |
| *F24F 13/20* | (2006.01) |
| *F24F 110/10* | (2018.01) |
| *F24F 110/20* | (2018.01) |

(52) U.S. Cl.
CPC ..... *F24F 8/90* (2021.01); *F24F 11/77* (2018.01); *F24F 2013/205* (2013.01); *F24F 2110/10* (2018.01); *F24F 2110/20* (2018.01)

(58) Field of Classification Search
CPC ..... F24F 2110/20; F24F 2110/10; F24F 2013/205; F24F 11/52; F24F 11/30; F24F 11/0008; F24F 11/67; F24F 11/64; F24F 11/46; F24F 11/74; F24F 11/65; F24F 11/755; F24F 13/04; F24F 11/0001; F24F 11/58; F24F 11/61; F24F 2110/74; F24F 2110/50; F24F 2011/0002; F24F 2110/64; F24F 2110/62; F24F 2110/68; F24F 2110/12; F24F 2120/10; F24F 2110/00; G05B 19/042; G05B 2219/2614; Y02B 30/70; A61G 13/108; G09G 3/3233; G09G 2320/0295; G09G 2320/0271; G09G 2300/0819; G09G 2320/045; G09G 2320/0233; G09G 2320/0693; G09G 2320/0276; G09G 2320/0673
See application file for complete search history.

(56) References Cited

U.S. PATENT DOCUMENTS

| | | | | |
|---|---|---|---|---|
| 2017/0142873 | A1 | 5/2017 | Ohashi | |
| 2021/0172632 | A1* | 6/2021 | Saunders | F24F 11/64 |

FOREIGN PATENT DOCUMENTS

| | | | |
|---|---|---|---|
| CN | 110030647 | A | 7/2019 |
| CN | 110906486 | A | 3/2020 |
| DE | 10201310906 | A1 | 2/2015 |
| EP | 1515097 | A1 | 3/2005 |
| JP | 1997033068 | A | 2/1997 |
| JP | 2005090934 | | 4/2005 |
| JP | 2005342509 | A2 | 12/2005 |
| JP | 2006057942 | A | 3/2006 |
| JP | 2016002085 | A | 1/2016 |
| KR | 101099796 | B1 | 12/2011 |
| KR | 20050115085 | A | 12/2025 |

OTHER PUBLICATIONS

Written Opinion of the International Preliminary Examining Authority issued in International Patent Application No. PCT/EP2021/053334 dated Feb. 11, 2022.
European Search Report and Written Opinion issued in European Patent Application No. EP20166863.9 dated Sep. 28, 2020.
International Search Report and Written Opinion issued in International Patent Application No. PCT/EP2021/053334 dated Apr. 20, 2021.

* cited by examiner

AIR PURIFIER

The present invention relates to an improved air purifier.

US 2005 055 990 discloses an air cleaner and method of controlling an operation of the same is disclosed. The air cleaner includes a cabinet having an inlet and an outlet; a filter assembly removing dust and smell particles from a room air; a fan; a sensor assembly sensing the composition of the room air; a supplier assembly providing at least one of insufficient components of the room air to a cleaned air; and a controller controlling the supplier assembly on the basis of data regarding the composition of the room air. In another aspect, the method of controlling the operation of the air cleaner includes steps of sensing a room air; measuring insufficient components of the room air and the amount thereof; and providing at least one of the insufficient components of the room air to a cleaned air.

CN 105 587 139 discloses an intelligent sentry box and a method for regulating the duty environment state by using the intelligent sentry box. The intelligent sentry box comprises a sentry platform (2) and a ceiling (4) arranged above the sentry platform (2), wherein an air guide device (41) which is provided with a first air outlet opening (17) and is used for guiding temperature regulating air flow to flow to people standing on the sentry platform (2) from the first air outlet opening (17) is arranged on the bottom surface of the ceiling (4). The intelligent sentry box also comprises an air conditioner, an air filter (20) and a negative ion generator (21), wherein the air conditioner is used for generating the temperature regulating air flow; the air filter (20) is used for purifying the temperature regulating air flow; and the negative ion generator (21) is used for generating negative oxygen ions in the temperature regulating air flow. The intelligent sentry box can provide good work environment for sentry personnel of military, police and civil sentry boxes, and the practicability is high.

CN 104 913 379 discloses an internet of things wall-embedded fresh air purification system having remote control and monitoring. The system comprises a circular shell, a circular inner shell, an airflow channel, a fan, an air intake device, an air exhaust device, a purification sterilization device, a heating device, an air quality sampling module, a monitoring module, a data transmission module, a control module and a control panel. The circular shell is embedded in a wall; the air intake device is embedded in the tail end of the circular shell; the circular inner shell is placed in the circular shell through a connecting device; one end is coated with the air intake device; and the other end is coated with the air exhaust device. The fan, the purification sterilization device and the heating device are arranged in the circular inner shell; and the controller is positioned at the lower end of the air exhaust device. The air intake device is provided with a filter screen and a closer. The inner sides of the air intake device, the circular inner shell and the air exhaust device are formed to a cylindrical first airflow channel; and gaps between the outer sides of the air intake device, the circular inner shell and the air exhaust device and the inner side of the circular shell are formed to a cylindrical second airflow channel. Outdoor air is purified, sterilized and heated to enter indoors from the first airflow channel; and indoor air flows outdoors from the second airflow channel.

CN 110 030 647 discloses a purifier which comprises a case. A fan, a drive device for driving the fan to rotate, and a filter for filtering air are arranged in the case; the case is provided with an air inlet and an air outlet; a negative-ion generator and a heater for heating an air flow are arranged on the air outlet; and a main controller for controlling the rotary speed of the drive device and controlling the heater to start and stop is further arranged in the case, so that the fan has at least two stages of air speeds, and the purifier is switched among an independent purification mode, a cold air and purification mode and a warm air and purification mode for working. The purifier integrates purifying, cooling and heating into a hole, not only has a simple purification function, but also has a function on discharging cold air and warm air, can be used all the year round, replaces the function of an air conditioner to a certain degree, and is beneficial to improving the indoor air quality and conducive to the health of a human body at the same time. The purifier has double purification structures of the filter and the negative-ion generator and has a good purification effect.

CN 110 906 486 discloses an air circulation type capillary network air conditioner and a control method thereof. The air circulation type capillary network air conditioner is mainly composed of an indoor temperature adjusting system and a fresh air system. During use, the fresh air system is used for replacing indoor air with clean air; then the indoor temperature adjusting system performs indoor circulation on the replaced air; the temperature is adjusted in the circulation process; air is released into a room through an open capillary network; due to the fact that the air subjected to temperature adjustment is directly released into a room through the capillary network, the room temperature can be quickly adjusted, noise and wind feeling cannot be generated like a traditional air conditioner, the fresh air system and the indoor temperature adjusting system both filter the air exhausted into the room, and the indoor air can be kept clean.

Despite the prior art there remains a need for improved air purifiers, in particular air purifiers which are more hygienic throughout their working life.

Air purifiers work by filtering ambient air through a filter. Accordingly, anything in the air is in theory capturable by the filter. While there are different types of filtration means, from particulate filter to gas filter, it is a necessary consequence of the functioning of an air purifier that they also capture microbes caught in the air flow.

It is also a routine feature of air purifiers that the main focus is removing pollution from the ambient air and various sensors which indicate that particulates are being removed exist. Consequentially, it also is quite routine for an air purifier to work in an automatic mode whereby the presence of particulates influences the air flow speed through the device. Thus, when the air quality is good, it is possible and often desirable that the purifier is maintained in idle or stand-by mode to conserve energy.

However, when air is not passing through the purifier micro-organisms caught by the filter are able to grow quickly and form biofilms which can have a deleterious effect on effective filter life span and also cause a health hazard to the users who habit the domestic setting. In addition, said microorganisms often harbour harmful viruses.

Accordingly, and in a first aspect there is provided an air purifier comprising a removable filter, an air flow generator, a temperature sensor, a humidity sensor, one or more processors for processing input from the temperature sensor and the humidity sensor, and means for activating said air flow generator from a stand-by configuration based on input from both said temperature and humidity sensors. Preferably, the air purifier is portable in that it is movable by a consumer. This is in contrast to fixed air conditioning systems.

We have surprisingly found that even a modest air flow rate, significantly below what might be termed standard filtration air flow rate, can prevent growth of micro-organisms and drastically reduce the prevalence of live micro-organisms being blown into the ambient air and also released into the environment during filter change.

Such micro-organisms include gram positive bacteria, gram negative bacteria, spores, moulds and fungi as well as any viruses in the air stream as well as those within said micro-organisms.

We have surprisingly found that by providing a low speed air draft we can drastically reduce micro-organism viability on the internal surfaces of the air purifier and in particular on the filter media. While the purifier is operating there is no increased risk of micro-organisms growing and multiplying on the filter. However, when it is in idle or stand-by mode and the conditions are favourable, the microorganisms grow.

In embodiments of the invention the purifier ascertains the likelihood of conditions conducive to micro-organism growth and when such conditions are deemed to exist it actuates the air flow generator from stand-by mode or idle, to destroy the microbes on the filter, or even those on the internal surfaces of the purifier.

Alternatively, when the processor determines that the conditions are conducive to micro-organism growth it either provides an indication, for example by way of a visual or audible signal, or electronically to a remote device such as a mobile phone so that the user is notified that the air flow generator should be employed, or it automatically actuates the fan or impeller at a low speed as described herein and which is sufficient to prevent micro-organism growth or to directly destroy the micro-organisms.

The processor or processors determine the probability of microbial growth based on temperature and humidity with reference to a look-up table to which it has access. The look up table may be different for different geographies as described herein.

Preferably, the purifier has first mode in which the choices are either: no action, where the conditions determined by the humidity sensor and temperature sensor are such that no or low micro-organisms growth is anticipated; an alert by way of an electronic signal to a mobile device to alert the user that conditions are favourable to micro-organisms and permitting the option for the user to actuate the fan; and a warning level where the user is warned that micro-organism growth is likely and strongly recommending to the user to actuate the fan or impeller.

A second mode may operate similarly in that indications are made determined by the input from the temperature and humidity sensors but instead of a warning or an alert, the machine is automatically turned on when conditions are such that micro-organism growth is likely.

The user of course may select one of these two modes where appropriate.

Temperature sensors are known in the art and are commercially available from Sensirion. Suitable examples of temperature sensors include STS3x series.

Humidity sensors are known in the art and are commercially available from Sensirion. Suitable examples of humidity sensors include SHT3x series.

Preferably, the means for generating an air flow is a fan or impeller. The fan may be a bladeless fan, an axial fan but it is preferred that the fan is a radial fan.

In a preferred embodiment the means for controlling the air flow generator based on input from said sensors is conducted automatically, for example by a processor. In such an embodiment the sensors sense the temperature and/or humidity on a continuous or intermittent basis and send information back to the processor. The processor determines whether the conditions are conducive to micro-organism growth based on at least temperature or humidity. Preferably, the processor determines whether the conditions are conducive to micro-organism growth based on temperature and humidity. More preferably, the processor determines the likelihood of micro-organism growth additionally based on parameters such as geographical location, time of the day, week, month or season or even the pollution levels as well as any specific conditions that occur, for example virus pandemics or bush fires, and combinations of any of these.

For example, in Asia, the wet seasons are typically defined by the monsoon and occurs in the summer. In contrast the summer in Europe and North America is characterised by drier weather. Similarly, the hemispheres have different seasonal characteristics.

Preferably, the geographical location is determined by GPS or through the purifiers WIFI capability. It may also be provided by way of user input during a set-up process.

Preferably, the air purifier comprises an ioniser. Preferably, the ioniser comprises a corona discharge tip and a receiving electrode. When the corona discharge tip is subjected to an appropriate electric voltage it generates an ion cloud between the tip and the receiving or ground electrode.

The ioniser may be disposed on the interior or the exterior of said purifier. Where the ioniser is disposed on the exterior of said device it is preferred that it is disposed at the top of the device. Locating the external ioniser at the top of the device means that domestic dust particles are ionised as they fall through the air towards the ground and are therefore more likely to aggregate as they become charged. As they become more aggregated they are more easily caught up in the air circulation pattern created by the device and so more easily filtered.

Where the ioniser is disposed in the interior of the device it is preferred that it is located before the removable particulate filter in an air flow direction.

Preferably, the device comprises an interior ioniser and an exterior ioniser. The exterior ioniser facilitating aggregation of domestic dust particles and the interior ioniser facilitating capture of the aggregated dust particles by the removable particulate filter. In both instances the ionisation permits less dense filtration media and low air speed (fan) speeds.

Preferably, the filter media comprises at least one of carbon, activated carbon, a non-woven, a thermoplastic, a thermosetting material, a porous foam, fibreglass, paper, a high loft spunbound web, a low loft spunbound web, a meltblown web and or a bi-modal fiber diameter meltblown media.

Preferably, the removable filter is a particulate filter. More preferably the removable filter is a High Efficiency Particulate Air (HEPA) filter. It is to be understood that while the filter part of an air purifier is a vital part of its function, air purifiers are not commonly manufactured with a filter in place. They are practically always manufactured separately and most importantly often by a different commercial enterprise than of the manufacturer of the air purifier itself. It is also typical for a manufacturer of filters to manufacture filters for different air purifier models made by different manufacturers. The particulate filter is to be contrasted with the pre-filter or any dust filter which is present. Pre-filters and dust filters are not considered HEPA filters as they do not have the particulate capturing capability exhibited by HEPA filters. Preferably, the filter is pre-charged before application to the air purifier.

Pre-filters are filters which have a low air resistance and also function as a poke guard, preventing the user from touching the volute or impeller assembly. The pre-filters are not intended to exhibit any major effect in the context of air purification. They do not have the air resistance or particle entrainment capability of dedicated particulate filters. Preferably the pre-filter is not a HEPA filter.

We have surprisingly found that the air draft required to kill micro-organisms is significantly lower than that required for air filtration. Accordingly, in a preferred embodiment the air purifier comprises means for controlling said air flow generator, a first air flow setting with an air filtration air flow speed and a second air flow setting which correlates with sterilisation of an internal surface of the air purifier and/or removable particulate or gas filter.

Preferably, the air flow speed measured at the removable filter at the first, air filtration setting is at least 1.5 $cms^{-1}$. The measurement at the filter medium is taken from the spatial centre point on the fan side of the filter media surface. Where there is more than one filter medium, the one taken for the air draft measurement is the one which is closest to the air flow generator and so receives the air draft first.

The air flow speed measured at the removable filter is known in the art as the media velocity. Media velocity is the velocity at which the air travels through the filter. Media velocity has to be controlled perfectly to ensure that the maximum amount of particles are trapped. Too fast and many of the pollutants fly straight through unfiltered. Too slow and the purifier is not reaching the farthest corners of your room quickly enough to be effective.

Preferably, the air flow speed (Media Velocity) measured at the removable filter at the second setting is from 1 to 40% the air flow speed generated at the first setting.

More preferably, the air flow speed measured at the removable filter at the second setting is from 0.1 to 1.2 $cms^{-1}$.

Most preferably, the air flow speed measured at the removable filter at the second setting is from 0.7 to 1.0 $cms^{-1}$.

Preferably, the processor actuates the air flow generator to generate an air flow commensurate with sterilisation of an internal surface of the air purifier and/or a filter media for a period of from 1 second to 10 hours.

The purifier is powered by any suitable power source including internal sources, e.g. batteries, and external power sources. The power is used to drive a motor which in turn powers at least the air flow generator and the ioniser where present.

In a second aspect there is provided a method for activating an air flow generator in an air purifier in stand-by mode, by obtaining information as to ambient temperature from a temperature sensor, obtaining information as to ambient humidity from a humidity sensor, determining likelihood of microbial growth on a removable filter in the purifier and, where conditions are such that microbial growth is of a defined threshold, activating the air flow generator.

Embodiments of the invention will now be described with reference to the following non-limiting figures.

FIG. 1 is a schematic showing the relationship between the processor and the sensors. The processor receives input from the temperature and humidity sensors. Once the conditions are calculated to be in the zone commensurate with significant micro-organism growth, the processor activates the ioniser or the fan to generate the ion cloud or the air draft which will reduce micro-organism growth.

Figure 2:
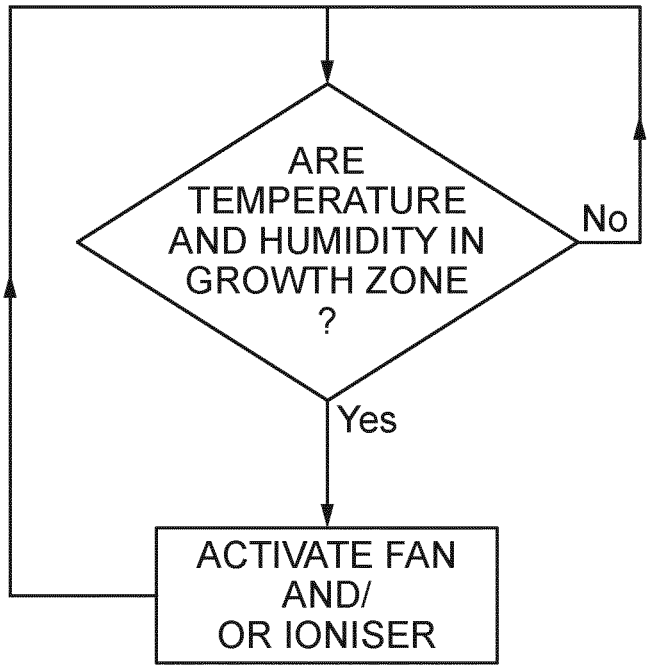

FIG. 2 is a schematic showing how the processor is supplied with information from the sensors (Temperature and humidity) so as to perform a calculation which determines whether micro=organism growth is likely to occur in a manner which could cause harm to the consumer.

If the processor determines that the conditions are conducive to micro-organism growth it activates either the fan, the ioniser or both in a controlled fashion. For example, the ioniser and the fan may be intermittently activated such that the internal surfaces are subjected to a pattern of ionisation and air draft; or that a lower level of air draft below what is required for air filtration.

EXAMPLE

Table 1 provides an example of the relationship between humidity and temperature and micro-organism growth. The consequential action can be modified by the user for example during set-up to tailor performance according to user needs and requirements.

TABLE 1

| | | Humidity (%) | | | | |
|---|---|---|---|---|---|---|
| | | 20 | 35 | 50 | 65 | 80 |
| Temperature (deg C.) | 10 | – | – | – | – | – |
| | 15 | – | – | – | – | – |
| | 25 | – | – | \ | \ | + |
| | 30 | – | – | \ | + | + |
| | 37 | – | \ | + | + | + |

TABLE 2

| | Mode 1 | Mode 2 |
|---|---|---|
| – | No action | No action |
| \ | Alert via App | Engage Germshield |
| + | Warn via App | Engage Germshield |

In Mode 1, the purifier merely alerts or warns the user by sending an electronic signal to a remote device, for example a mobile phone. If the user is so minded, he or she may actuate the purifier remotely thereby reducing micro-organism growth on the filter or internal surface of the purifier. Alerting the user means indicating that the growth of micro-organisms is possible and that actuation of the purifier's fan is advised. Warning the user means that the growth of micro-organisms is highly likely and that actuation of the fan is strongly advised.

In Mode 2, the purifier automatically engages the Germshield mode, i.e. by automatically operating the fan at a speed which prevents micro-organism growth. This is done without any engagement by the user.

The invention claimed is:

1. An air purifier comprising a removable filter, an air flow generator, a temperature sensor, a humidity sensor, one or more processors for processing input from the temperature sensor and the humidity sensor, and the one or more processors are configured to activate said air flow generator from a stand-by configuration based on the input from both the temperature and the humidity sensors, and the one or more processors determining a likelihood of microbial growth on the removable filter in the air purifier as being at a defined threshold.

2. The air purifier according to claim 1 where the air flow generator is a fan.

3. The air purifier according to claim 1 wherein the one or more processors are configured to activate said air flow generator automatically based on the input from the temperature and the humidity sensors and the one or more processors determining the likelihood of microbial growth on the removable filter in the air purifier as being at the defined threshold.

4. The air purifier according to claim 1 further comprising an ioniser.

5. The air purifier according to claim 1 where the removable filter is a particulate filter or a gas filter.

6. The air purifier according to claim 1 wherein the air purifier does not comprise a heater.

7. A method for activating an air flow generator in an air purifier in stand-by mode comprising:

obtaining information as to ambient temperature from a temperature sensor;

obtaining information as to ambient humidity from a humidity sensor;

determining a likelihood of bacteria or virus growth on a removable filter in the purifier;

determining the likelihood of bacteria or virus growth on the removable filter in the air purifier as being at a defined threshold; and activating the air flow generator.

* * * * *